US005802773A

United States Patent [19]

Pingel

[11] Patent Number: 5,802,773

[45] Date of Patent: Sep. 8, 1998

[54] HANDICAP ACCESSIBLE STAIR

[76] Inventor: Nathan W. Pingel, 426 E. Whittier, Columbus, Ohio 43206

[21] Appl. No.: 754,744

[22] Filed: Nov. 21, 1996

Related U.S. Application Data

[63] Continuation of Ser. No. 346,631, Nov. 30, 1994, abandoned.

[51] Int. Cl.[6] ..... E04H 3/12

[52] U.S. Cl. ..... 52/10; 52/183

[58] Field of Search ..... 52/6, 9, 10, 182, 52/183; 414/540, 545; 198/326, 333

[56] References Cited

U.S. PATENT DOCUMENTS

| | | | |
|---|---|---|---|
| 3,394,505 | 7/1968 | Rife | 52/182 X |
| 4,633,625 | 1/1987 | Dieban et al. | 52/6 X |
| 4,854,092 | 8/1989 | Chatenay | 52/6 X |
| 4,930,277 | 6/1990 | Krumholz et al. | 52/182 X |
| 5,251,862 | 10/1993 | Raymond | 248/396 |
| 5,271,707 | 12/1993 | Derksen et al. | 414/680 |
| 5,287,580 | 2/1994 | Nelson | 14/71.3 |
| 5,295,569 | 3/1994 | Kubota | 198/333 |
| 5,299,904 | 4/1994 | Simon et al. | 414/541 |
| 5,308,214 | 5/1994 | Crain et al. | 414/541 |
| 5,316,432 | 5/1994 | Smalley et al. | 414/540 |
| 5,319,813 | 6/1994 | DiMatteo et al. | 5/81.1 |
| 5,319,818 | 6/1994 | Baranowski | 14/71.1 |
| 5,322,408 | 6/1994 | Wooden | 414/495 |
| 5,330,042 | 7/1994 | Ogimura et al. | 198/333 |
| 5,332,077 | 7/1994 | Ogimura | 198/333 |
| 5,333,334 | 8/1994 | Kassai | 5/85.1 |
| 5,335,741 | 8/1994 | Rabinovitz et al. | 180/8.2 |
| 5,341,126 | 8/1994 | Boykin | 340/573 |
| 5,353,907 | 10/1994 | Ogimura et al. | 198/333 |

*Primary Examiner*—Lanna Mai
*Attorney, Agent, or Firm*—Standley & Gilcrest

[57] ABSTRACT

A stair which has independent, infinitely variable height steps. The steps collectively form a platform for raising or lowering an individual and return to form a configuration of a stair.

14 Claims, 5 Drawing Sheets

HANDICAP ACCESSIBLE STAIR

This application is a file wrapper continuation of application Ser. No. 08/346,631 filed Nov. 30, 1994, now abandoned.

BACKGROUND AND SUMMARY OF THE INVENTION

The present invention relates generally to the art of handicap accessible stairs and more particularly to an arrangement for a collapsible hydraulic and/or electric stair for handicap access, including wheelchair access.

Handicap accessibility to buildings and structures have become a major concern to society and such interest, it seems, will only increase with time. Society has recognized the importance of integrating handicapped individuals into the working environment after realizing the benefits handicapped individuals provide through their services. It is also recognized that providing accessibility to handicapped individuals not only increases their freedom of movement but also increases their independence. Therefore, handicapped individuals are increasingly able to take care of themselves and reduce their dependency on others and society. Such consequences affect not only the physical freedom of the handicapped individual but can greatly improve their psychological state, including their self-esteem.

Recently, the United States Congress responded to the awareness of the benefits provided by increased handicap access by enacting the Americans with Disabilities Act (hereinafter ADA). This act sets forth minimum handicap accessibility requirements for public buildings. The ADA requires building owners to improve access to their buildings. As a result of this requirement, building owners are in search of effective means to cost effectively meet the requirements of the ADA. Contractors and designers have attempted to tackle these problems but have met with only limited success.

One of the greatest problems being faced by the owners is that of providing access to buildings that have a change in elevation in the entrances to the buildings or in their interior. A non-handicapped individual has little difficulty overcoming most physical obstacles placed before them. However, an individual that has difficulty climbing or descending stairs, such as when limited to travel through the use of a wheelchair, may view those same obstacles as complete blockages to such travel. In the past, owners have responded to this problem by providing lifts or ramps. These installations are often installed adjacent to existing stairs and thus requires additional space. Alternatively, owners have retrofitted existing stairs with ramps, or replaced the stairs altogether with a ramp. Such installations are at best compromises between the competing interests of walking individuals, impaired walking individuals, wheel-chaired individuals, and building owner's space and cost limitations.

Another difficulty facing handicap accessibility designers is the maintenance of the historical aesthetic qualities of architecture. In the past, designers had to compromise to satisfy building owners and historical preservationist societies. In some circumstances, the upgrading of a building to meet handicap accessibility requirements may have been prohibited because of certain preservationist controls. A design is needed that is cost effective to the owner, that provides easy access to all, and that maintains a building's historical aesthetic qualities.

The present invention overcomes the disadvantages that plague previous designs and fills the need for cost effective, universal access. The present invention is an electric and/or hydraulic stair that is capable of assuming the shape of a level platform that can be raised and lowered for the purpose of allowing individuals with walking disabilities to gain access to buildings. One unique feature of the present invention is that each individual step is raised and lowered by a mechanism that may be independent of other steps. Another unique feature of the present invention is that each step remains level as the stair steps are raised or lowered. It is also to be appreciated that the present invention is not limited to use only in conjunction with a building but may be used anywhere a stair would be helpful.

The present invention also overcomes many of the difficulties associated with maintaining the historical aesthetics of a building. The present invention may utilize any type of step material and may replace many existing stairs. In many instances, stairs may be bounded by decorative walls that would have been removed to install previous handicap access systems. The present invention requires no more space than the original stair and can coexist with any aesthetic features that accompany a building. Therefore, decorative walls remain intact and can continue to serve the aesthetic purposes of the building. The present invention has the ability to accomplish all of the above and still meet all requirements of the ADA.

The present invention also provides many safety features not present in previous systems. As an example, the present invention may be fitted with a battery to operate the stair when a power outage is experienced. This can be crucially important during a disaster such as a fire. It is also a safety feature of the present invention that allows the stair to slowly assume a low-level flat surface if a hydraulic failure is experienced. The system can slowly bleed hydraulic fluid from the hydraulic actuators that support each step to bring each step level with the ground.

Other principal features and advantages of the invention will become apparent to those skilled in the art upon review of the following detailed description, claims and drawings.

DETAILED DESCRIPTION OF PREFERRED EMBODIMENTS

Figure 1:
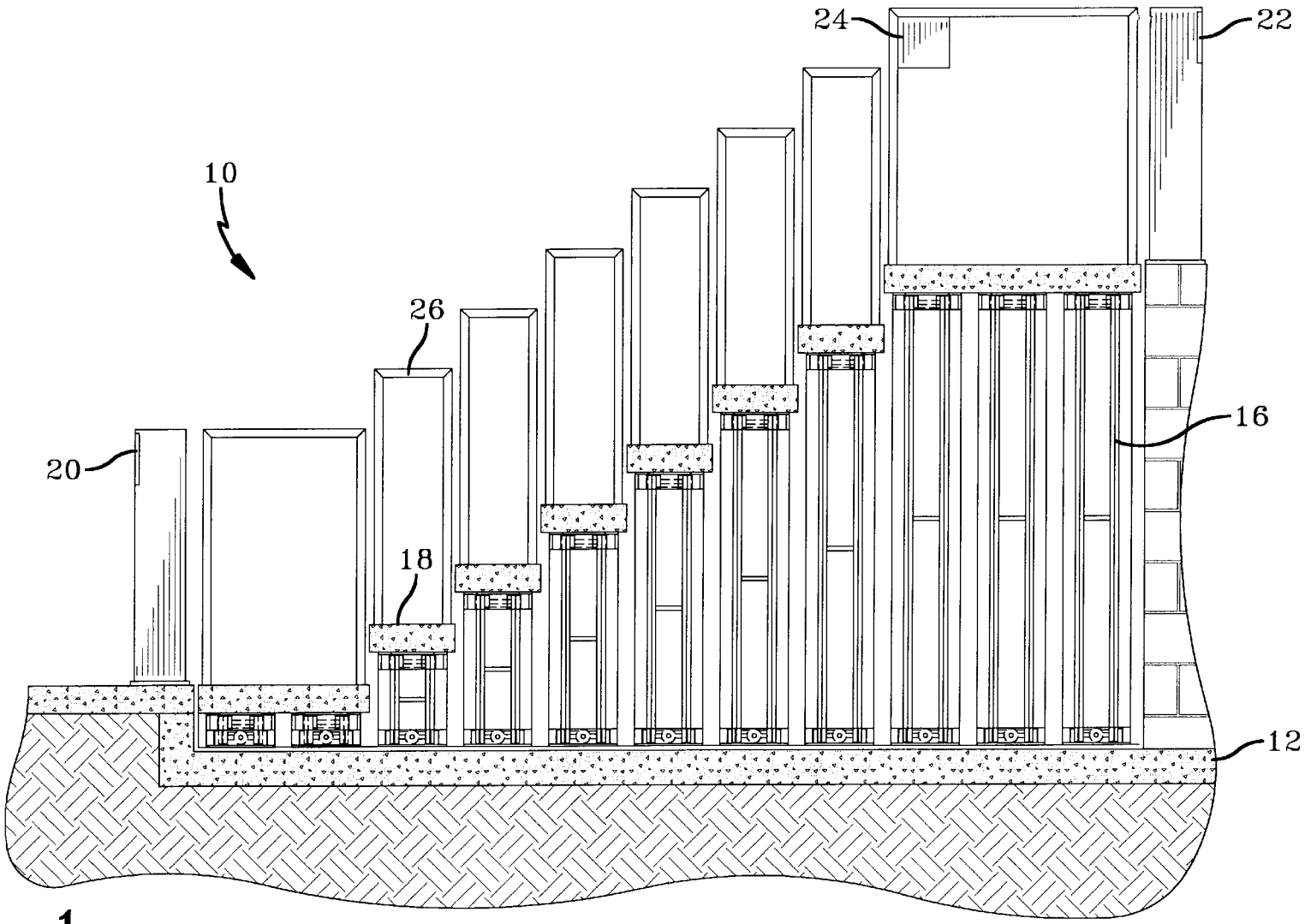
FIG. 1 is a side elevation view of one embodiment of the present invention.

Referring to FIG. 1, a side elevation view of one embodiment of the present invention is shown at 10. A foundation 12 may be prepared to serve as a level support for the remaining elements of the stair. The foundation may be laid below the surface of the existing grade of the lower landing to the stair to allow for the height of the collapsed stair and to provide a level transition from the existing grade to the collapsed stair.

Each individual step of the invention is supported by an independent step elevator, shown generally at 16. Each step elevator supports a step block 18 which may consist of any material suitable for stair steps. It is to be appreciated that the present invention is not limited to any type of step material and can accommodate all historical aesthetic requirements of buildings. Controls may be located at the lower landing of the stair 20, the upper landing of the stair 22 and at a platform adjacent to the upper landing of the stair as shown at 24 or adjacent to the lower landing which is not shown. Handrails may be attached to each step as shown generally at 26. The handrails depicted are also not limiting to the present invention and it is contemplated that any type of decorative handrails may be accommodated.

Figure 2:
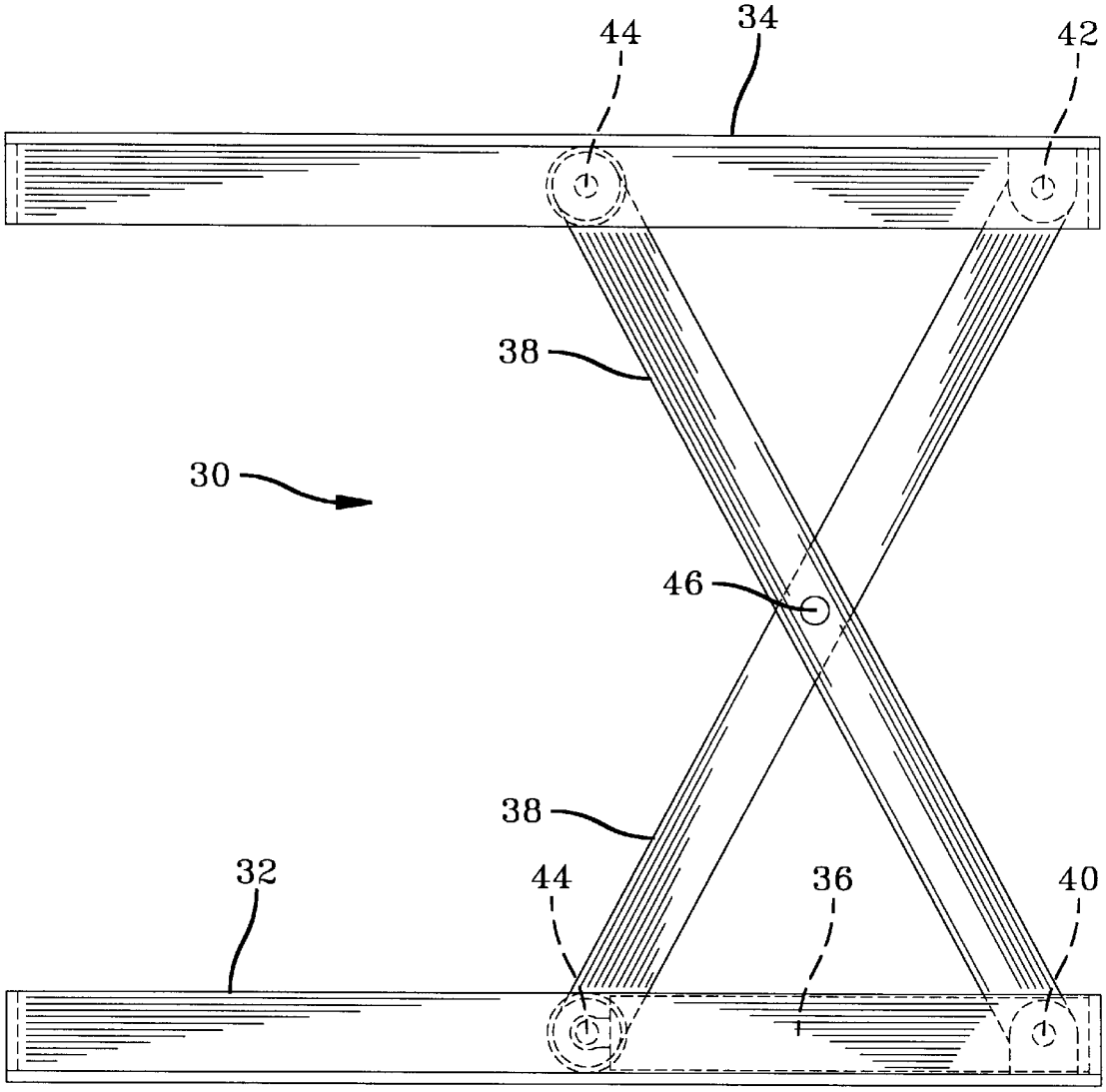
FIG. 2 is a front elevation view of one step elevator of the embodiment of FIG. 1 in its extended configuration.

Referring to FIG. 2, a side elevation view of a step elevator is shown at 30. Each step elevator preferably comprises a base 32, a step platform 34, a hydraulic actuator 36 and two pair of supports 38. Each support pair is hinged to one end of either the base 32 at 40 or the step platform 34 at 42. Opposite ends of each support preferably have a support roller shown generally at 44. The supports pivot with respect to each other on a hinge 46. Operation of the step elevator can be visualized in FIG. 2. To raise the step platform the hydraulic actuator compresses and brings the lower ends of the supports closer together. The supports pivot with respect to each other and raise the step platform. Preferably, the step platform maintains a parallel relationship with the base throughout its motion. It is to be appreciated that the height of the step elevator may be infinitely variable to allow for stair riser regulation differences. The present invention may be programmed to stop at the appropriate height to comply with local riser regulations.

The operation of the present invention can now be explained with reference to FIG. 1. An individual may approach the control panel 20 at the lower landing and may input a command into the control system of the stair. Preferably, the command initiates the process of moving all steps 18 of the stair 10 until it is approximately level with the level of the approach to the stair. At this point, the individual can freely cross the span of the stair 10 across all steps 18 in its configuration as a single platform. The individual may then access the control panel 24 and input a command into the control system of the stair. This command input initiates bringing the level of the platform, comprised of all of the steps 18, to the level of the upper landing of the stair. It is to be noted that the railings 26 guard against an individual accidentally leaving the stair. Once the steps 18 match the level of the upper landing the individual may then leave the stair and, once clear, may access the control panel 22 to input another command to cause the present invention to assume the configuration of a series of steps as is shown in FIG. 1.

Sensors may be placed on the present invention to guard against foreign object entanglement with the steps of the stair. Preferably, the sensors communicate with the control system of the present invention to prevent operation of the stair. Additionally, a safety skirt may be attached to a step of the present invention to prevent foreign object entanglement with the operation of the stair.

Preferably, all of the steps are capable of moving to a level even with the grade of the upper and lower landings to the stair. Alternatively, each of the steps 18 may move only to the level that each step assumes when the present invention assumes the stair configuration as is shown in FIG. 1. In another embodiment of the present invention, the step adjacent to the upper landing may be the only step that would be moved to a level even with the level of the upper landing. However, in this embodiment, it is appreciated that all steps move to a level even with the lower landing. This embodiment requires the step adjacent the upper landing to be large enough to accommodate the individual being raised. This embodiment obviates the necessity of the control panel 22 because the present invention would not have to return to a stair configuration because it would already be in that configuration. In the preferred embodiment, all of the steps move to the level of the lower landing. Therefore, the step adjacent the upper landing would not need to be large enough to accommodate the individual. Moving the level of all the steps as a single platform provides a great advantage in that the all steps of the stair may be utilized to accommodate the individual. This is especially useful where only a few steps are available or where only a very small space is available for the stair. It is to be appreciated that the configuration the stair assumes is infinitely variable as each step 18 is supported by individual step elevators 16. The present invention preferably allows the programming of any configuration desired. It is to be appreciated that the present invention may be utilized for either an ascending or a descending entrance to a building.

Figure 3:
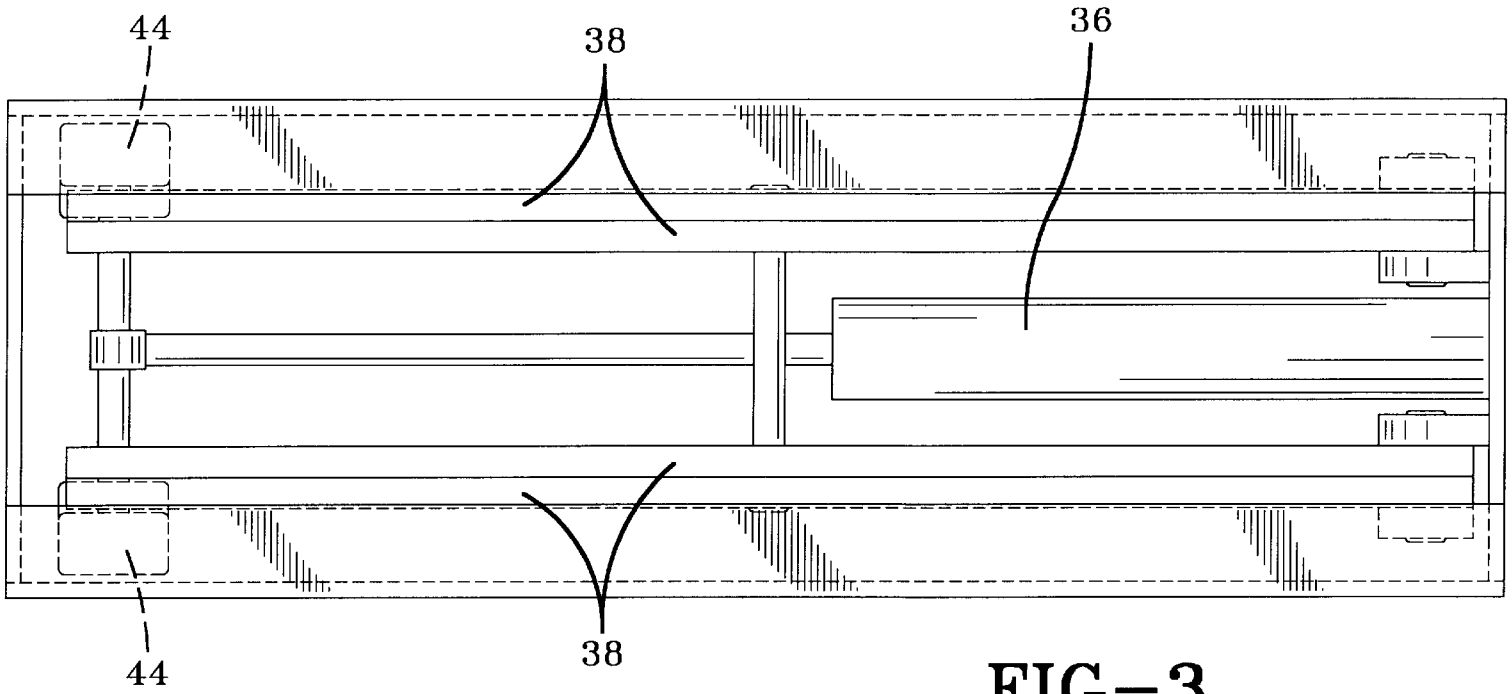
FIG. 3 is a plan view of the step elevator of FIG. 2 in its collapsed configuration.
Figure 4:
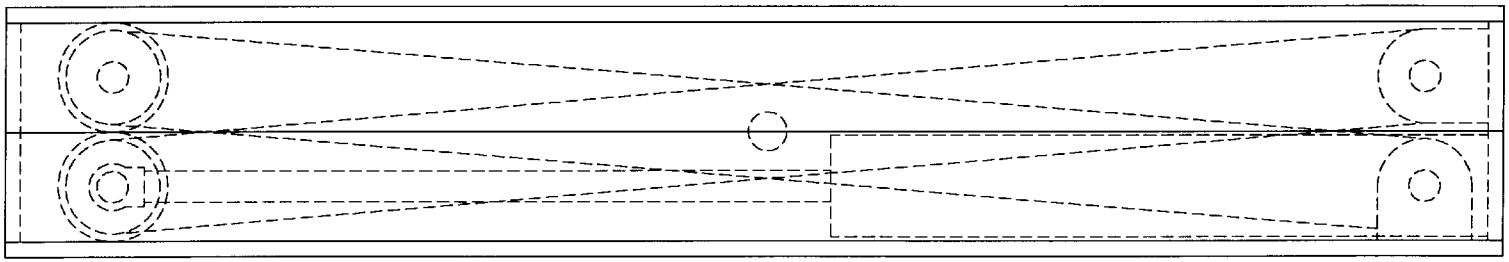
FIG. 4 is a front elevation view of the step elevator of FIG. 3.

FIG. 3 shows a plan view of the step elevator of FIG. 2 in its collapsed configuration. Similarity, FIG. 4 shows a side elevation of the step elevator of FIG. 2, also in its collapsed configuration. The hydraulic actuator 36 can be seen more clearly as can the location of the rollers 44 connecting the supports 38. It should be noted that the hydraulic actuator is fully extended when the step is in the collapsed configuration. Preferably, the width of the step elevator is approximately equal to the width of a step. The use of a step elevator for each step provides the ability for infinite variations on the step rise rate and the number of steps in the stair.

Figure 5:
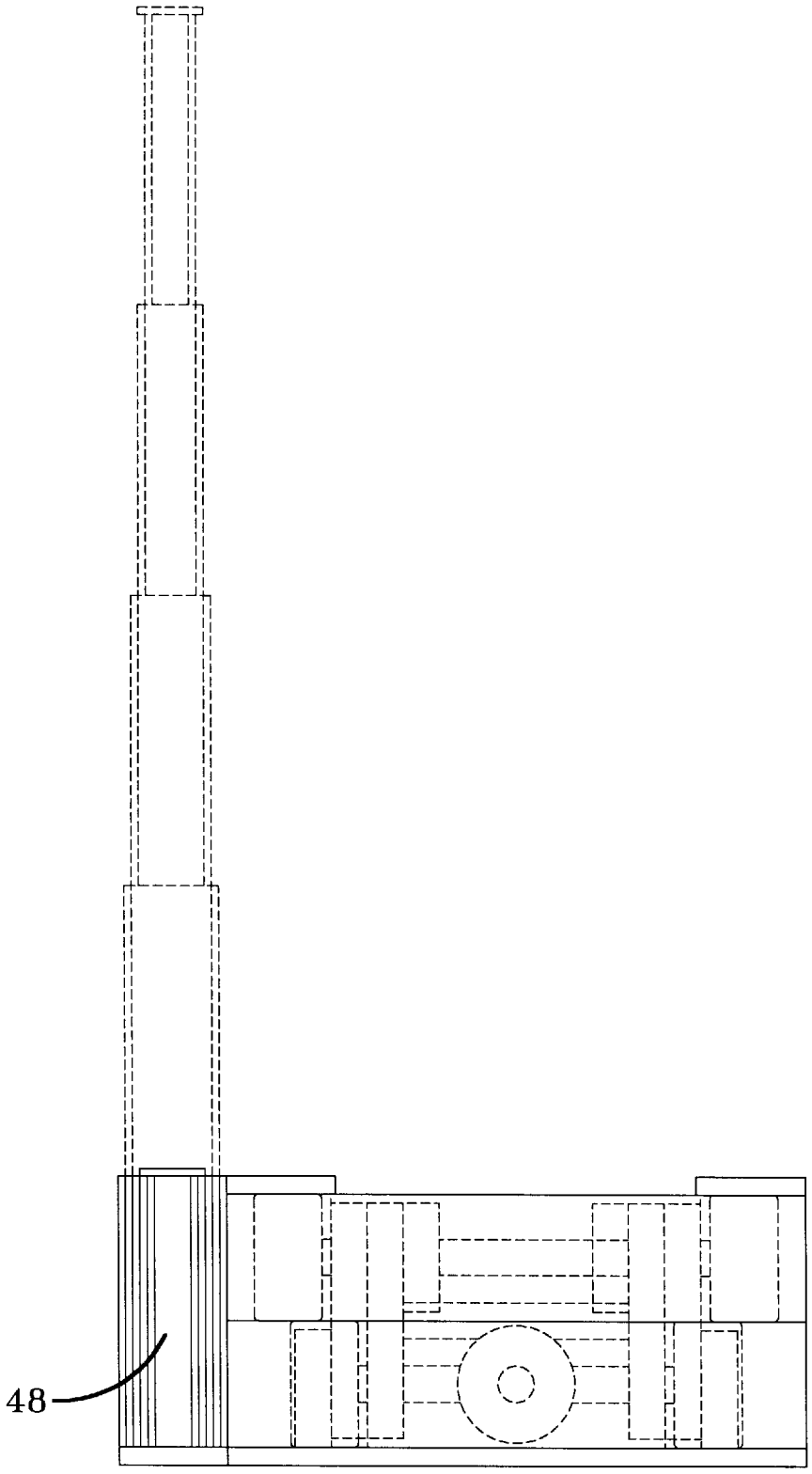
FIG. 5 is a side view of a step elevator showing a hydraulic guard.

Referring to FIG. 5, a step elevator is shown that is equipped with a hydraulic guard 48. The guard is shown in its collapsed configuration by solid lines and in its extended configuration by dashed lines. The guard may be attached to a step to prevent accidental exit from the step. This guard may be used on any step desired and may be placed anywhere on the stair where it is logical according to the programming of the stair and the use intended for the stair.

Figure 6:
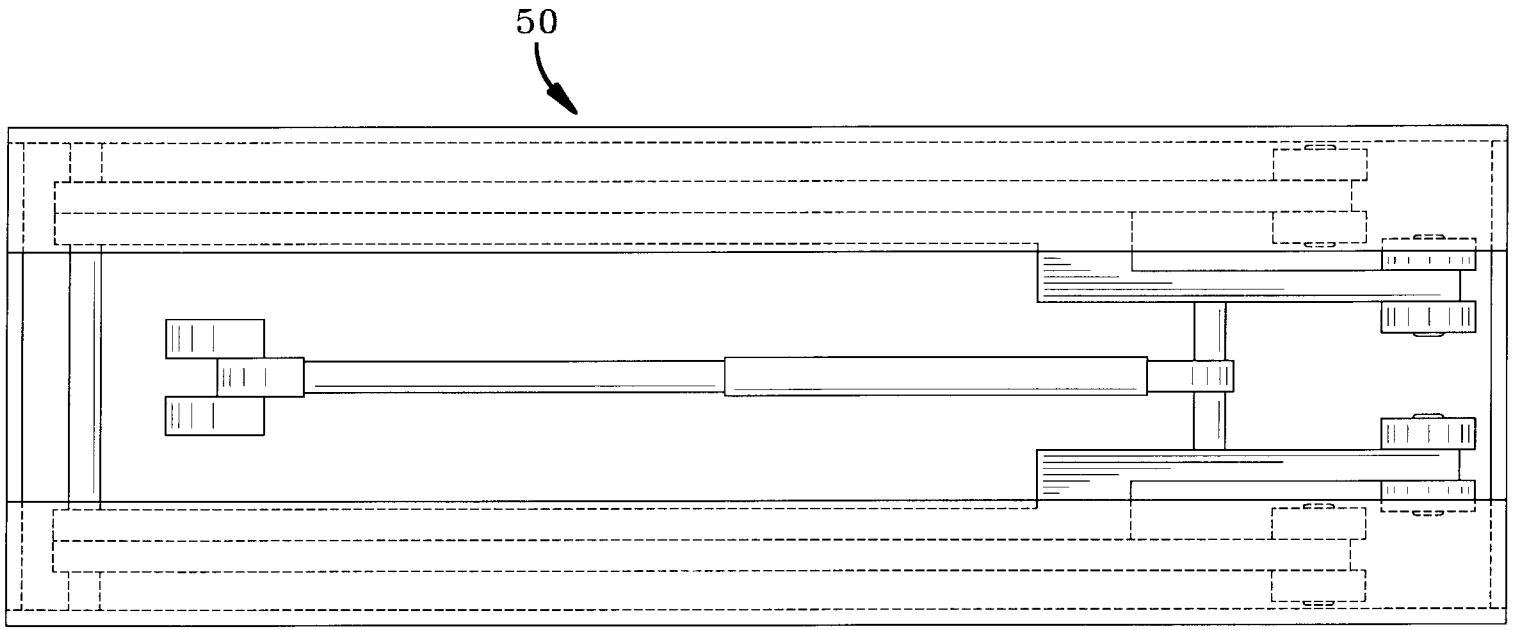
FIG. 6 is a plan view of a portable and modular step elevator.
Figure 7:
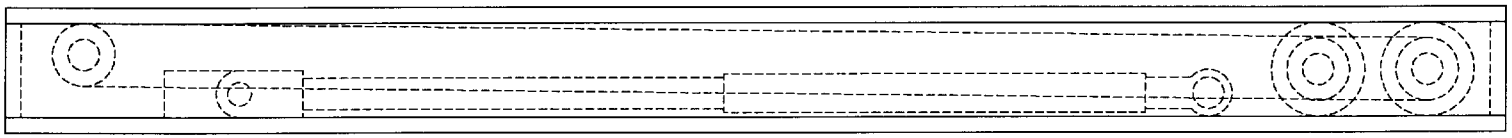
FIG. 7 is a side view of the step elevator of FIG. 6.

FIGS. 6 and 7, show a portable and modular step at 50. This step can accommodate a variety of foundational supports. The unit is compact and may be easily transported to any desired location. It is contemplated that the unit would be useful for temporary sites where a permanent installation may not be feasible or cost effective. The portable step is utilized in groups where necessary and placed abutting other steps in a configuration similar to that disclosed in FIG. 1. The ability of a stair to be infinitely variable according to programming, as explained above, is preserved while utilizing the portable step.

The scope of the invention is not to be considered limited by the above disclosure, and modifications are possible without departing from the spirit of the invention as evidenced by the following claims.

What is claimed is:

1. A method for providing access for a handicapped individual, which comprises the steps of:

providing a first variable height step elevator as a first riser to a stair;

providing a second variable height step elevator as a second riser to a stair;

changing the elevation of the upper surfaces of each of said first and second step elevators to form a single platform and to match the level of an approach landing upon which a handicapped individual is supported;

changing the elevation of said single platform to match the level of a departure landing;

changing the elevation of the upper surface of said first step elevator to form a first riser to said stair; and changing the elevation of the upper surface of said second step elevator to form a first riser to said stair.

2. The method of claim 1, further comprising the step of providing a railing to one of said steps.

3. The method of claim 1, further comprising the step of providing a foundation to support each of said first and second step elevators.

4. The method of claim 1, further comprising the step of providing a control for controlling the movement of said first and second step elevators.

5. The method of claim 4, wherein the step of providing a control comprises the following steps:

providing a first control proximate to the approach of said stair;

providing a second control to one of said step elevators; and providing a third control proximate to the departure of said stair.

6. A handicap accessible stair, comprising:

a first step rising from a lower landing, said first step forming a first riser in said stair, wherein said first step has an upper surface;

a second step positioned adjacent said first step and forming a second riser in said stair, wherein said second step has an upper surface, wherein said second step upper surface is located a vertical distance above said first step upper surface;

a control operably connected to said first and second step, wherein said control causes vertical movement of said first and second step down to a position wherein said first and second step upper surfaces are level with said lower landing, and said control further causes vertical movement of said second step to said position to form said second riser in said stair; and whereby said stair provides improved mobility to handicapped users while preserving the aesthetic qualities of said stair.

7. The stair of claim 6 wherein said first step comprises:

a first step platform;

a first base;

a first hydraulic actuator, connected to said first base;

two pair of supports, wherein each said support pair is hinged to one end of either said first base or said first step platform;

a pair of hinges, each connected to one of said pair of supports of said first step for allowing said pair of supports of said first step to move pivotally with respect to each other; and wherein said first hydraulic actuator compresses which acts to raise said first step platform.

8. The stair of claim 6, further comprising a railing attached to said first step.

9. The stair of claim 6, further comprising a backstop secured to said first step, wherein said backstop vertically extends to a position that prevents undesired movement of an individual off said platform.

10. The stair of claim 6 further comprising a foundation supporting each of said steps.

11. The stair of claim 6, wherein said control comprises:

a first control panel operably connect to said first and second step and located proximate to said lower landing of the stair, wherein said first control panel causes a downward vertical movement of said first and second step to result in a platform level with said lower landing;

a second control panel operably connected with said first and second step and located proximate to an upper landing of the stair, wherein said second control panel causes vertical movement of the level platform of said second step to the level of said upper landing of said stair; and a third control panel operably connected with said first and second step and located at said upper landing of said stair, wherein said third control panel causes said first step to form said first riser of said stair and causes said second step to form said second riser of said stair.

12. A handicap accessible stair, comprising:

a foundation;

a first step resting on said foundation, wherein said first step comprises:

a first step platform;

a first base;

a first hydraulic actuator, connected to said first base;

two pair of supports, wherein each said support pair is hinged to one end of either said first base or said first step platform;

a pair of hinges, each connected to one of said pair of supports of said first step for allowing said pair of supports of said first step to move pivotally with respect to each other; and wherein said first hydraulic actuator compresses which acts to raise said first step platform a first step rail attached to said first step;

a second step resting on said foundation, wherein said second step comprises:

a second step platform;

a second base;

a second hydraulic actuator connected to said second base;

two pair of supports, wherein each said support pair is hinged to one end of either said second base or said second step platform;

a pair of hinges, each connected to one of said pair of supports of said second step for allowing said pair of supports of said second step to move pivotally with respect to each other; and wherein said second hydraulic actuator compresses which acts to raise said second step platform;

a second step rail attached to said second step;

a first control panel operably connected to said first and second steps and located proximate to the approach of said stair, wherein said first control causes said first and second upper surfaces to move to a level even to said approach of said stair to form a single platform from said first and second upper surfaces;

a second control panel operably connected to said first and second steps and attached to one of said steps, wherein said second control causes said single platform to move to a level even with the departure of said stair; and a third control panel operably connected to said first and second steps and located adjacent to the departure of said stair, wherein said third control panel causes said first step to return to form a first riser of said stair and causes said second step to return to form a second riser of said stair.

13. A handicap accessible stair adjacent to an upper landing and lower landing, comprising:

at least one stair;

a step platform, said step platform extendable to a level above said at least one stair;

raising and lowering means for lowering and raising said at least one stair and said step platform;

a control for controlling said raising and lowering means to lower said at least one stair and said step platform to a level even with said lower landing; said control also capable of controlling said raising and lowering means to raise said step platform to a level even with said upper landing; and wherein said control is actuable by a handicapped person so that said handicapped person may freely cross said at least one stair and said step platform when said at least one stair and said step platform are at a level even with said lower landing and wherein said handicapped person may actuate said control to raise said step platform to a level even with said upper landing.

14. A handicap accessible stair according to claim 13, wherein said control is actuated by a first control panel located at said lower landing, said first control panel for lowering said at least one stair and said step platform to a lower level even with said lower landing; wherein said control is actuated by a second control panel located on said step platform, said second control panel for raising said step platform to a level even with said upper landing; wherein said control is actuated by a third control panel on said upper landing, said third control panel for raising said step platform to a level even with said upper landing and lowering said step platform and said at least one stair to a level even with said lower landing.

* * * * *